US005156450A

United States Patent [19]

Lee

[11] Patent Number: 5,156,450

[45] Date of Patent: Oct. 20, 1992

[54] PORTABLE SOAP CADDY ASSEMBLY

[76] Inventor: Reginald D. Lee, 500 Park Ave. #638, Calumet City, Ill. 60409

[21] Appl. No.: 650,919

[22] Filed: Feb. 5, 1991

[51] Int. Cl.[5] ..... A47G 67/02

[52] U.S. Cl. ..... 312/248; 312/245; 312/229; 312/351; 248/205.5

[58] Field of Search ..... 132/314, 315; 312/351, 312/245, 327, 248, 270, 282; 248/206.2, 206.3, 205.5, 691, 556; 211/75, 76

[56] References Cited

U.S. PATENT DOCUMENTS

| | | | |
|---|---|---|---|
| 2,351,610 | 6/1944 | Hamberg | 312/282 X |
| 2,876,980 | 3/1959 | Salter | 248/206.3 X |
| 3,054,211 | 9/1962 | Hawk et al. | 312/351 |
| 3,220,790 | 11/1965 | White | 312/282 X |

*Primary Examiner*—Joseph Falk

[57] ABSTRACT

A portable soap caddy assembly with a toiletry receptacle having an opening and a sidewall for holding various toiletries and having means for mounting the receptacle to a vertical wall with opening facing upwardly. This assembly provides an auxiliary receptacle with an opening and sidewalls and a mounting assembly for movably mounting the auxiliary receptacle to the toiletry receptacle between a first open position where the sidewall of the toiletry receptacle closes the opening of the auxiliary receptacle and a second position where the auxiliary opening is opened facing upwardly. A further assembly has an auxiliary receptacle with an opening, sidewall and bottom and means for mounting the auxiliary receptacle to the toilety receptacle to close the opening of the toiletry receptacle. In addition, means for partitioning the auxiliary receptacle opening from the toiletry receptacle opening is provided and means for holding the auxiliary receptacle against the sidewall of the toiletry receptacle with the auxiliary opening facing upwardly. Finally another assembly has a releasable attachment mechanism to mount the portable soap caddy assembly and means for mounting the releasable attachment mechanism between a wall mounting position in which the mechanism is in position to releasably attaching toiletry receptacle to the wall and a storage position in which the mechanism is releasably secured to the sidewall of the toiletry receptacle.

21 Claims, 2 Drawing Sheets

PORTABLE SOAP CADDY ASSEMBLY

BACKGROUND OF THE INVENTION

1. Field of the Invention

The present invention relates to a portable soap caddy assembly, and more particularly, a portable soap caddy assembly having an auxiliary receptacle which is conveniently mounted to the assembly and an attachment mechanism to releasably attach the assembly to a wall.

2. Description of the Prior Art

Various assemblies are known to carry toiletry and other consumable items. However, none of these devices have an auxiliary receptacle with a mounting assembly to movably mount the auxiliary receptacle to a main receptacle in order to move the auxiliary assembly to a first position in which a sidewall of the main receptacle closes the opening of the auxiliary receptacle and to move the auxiliary, receptacle to a second position in which the auxiliary opening is facing upwardly for access to the auxiliary receptacle. In U.S. Pat. No. 3,008,788 issued Nov. 14, 1961, to Garner, none of these containers are add-on or auxiliary containers. They are compartments disposed in a container. Further, since none of these compartments are auxiliary none, are movably mounted where an opening is closed against a sidewall in one position and opened upwardly in another. In U.S. Pat. No. 3,054,211 issued Sep. 18, 1962, to Hawk et al, there is no auxiliary receptacle movably mounted, where in one position its opening is closed against the sidewall of a main receptacle or in another position it is opened upwardly for access. This device is a singular container with a pivotally mounted lid.

Further, various assemblies are known to have multiple receptacles in which one receptacle closes another receptacle. This for example is true with a conventional thermos bottle. However, none of these types of assemblies have a means for holding one of the receptacles to the sidewall of the other receptacle orienting the openings upwardly.

Further, various assemblies are known for releasably attaching containers to a wall, however, none has a means for mounting such attaching devices between a wall mounting position and storage position where the attaching device is releasably secured to the sidewall of the container. In U.S. Pat. No. 3,054,211, issued Sep. 18, 1962, to Hawk et al, it does not have a mounting means which places the attaching device between a securing position to the wall and a storage position secured to the sidewall of the container. This device has a singular positioned attaching device. In U.S. Pat. No. 3,869,183, issued Mar. 4, 1975, to Frank, Jr., it does not have a mounting means which places the releasable attachment mechanism in a storage or non-usable position.

SUMMARY OF THE INVENTION

It is therefore an object of this invention to provide a portable soap caddy assembly with a toiletry receptacle having an opening and a sidewall and a means for mounting the receptacle to a vertical wall with the opening facing upwardly. The assembly has an auxiliary receptacle with an opening and auxiliary receptacle sidewalls. This invention further provides a mounting assembly for movably mounting the auxiliary receptacle to the toiletry receptacle between a first position in which the auxiliary receptacle opening is closed against the sidewall and a second position in which the opening of the auxiliary receptacle is open and facing upwardly for access to the auxiliary receptacle.

It is a further object of this invention to provide a portable soap caddy assembly with a toiletry receptacle for holding various toiletries having an opening and a sidewall and means for mounting the receptacle to a vertical wall with the opening facing upwardly. The assembly having an auxiliary receptacle with an opening, a sidewall and a bottom. This invention further having means for mounting the auxiliary receptacle to the toiletry receptacle to close the toiletry receptacle opening; means for partitioning the auxiliary receptacle opening from the toiletry receptacle opening; and means for holding the auxiliary receptacle against the sidewall of the toiletry receptacle with the auxiliary receptacle opening facing upwardly.

It is a further object of this invention to provide a portable soap caddy assembly with a toiletry receptacle having an opening and a sidewall for holding various toiletries which has a releasable attachment mechanism. The assembly further has means for mounting the releasable attachment mechanism between a wall mounting position in which the releasable attachment mechanism is in a position for releasable attachment of the toiletry receptacle to the wall and a storage position in which the releasable attachment mechanism is releasably secured to the sidewall of the toiletry receptacle.

BRIEF DESCRIPTION OF THE DRAWINGS

The foregoing objects and advantageous features of the invention will be explained in greater detail and others will be made apparent from the detailed description of the various embodiments of the present invention which are given with reference to the several figures of the drawing, in which.

DETAILED DESCRIPTION

Figure 1:
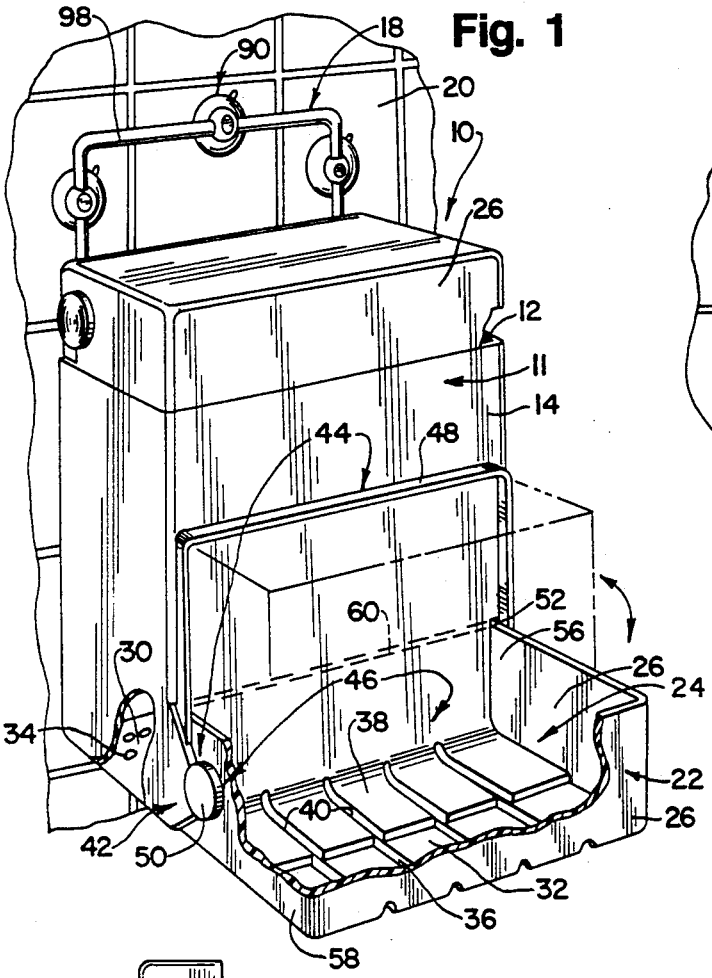
FIG. 1 is a partially broken away perspective view of the portable soap caddy assembly in which the auxiliary receptacle is partially broken away in an open position and is in phantom in a closed position.
Figure 2:
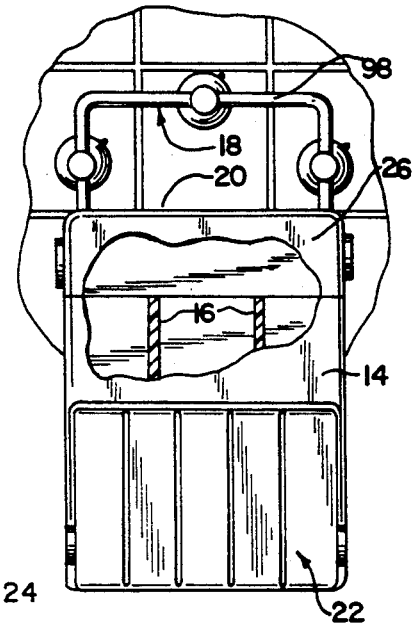
FIG. 2 is a front elevation view of the portable soap caddy assembly in which the toiletry receptacle is partially broken away and the auxiliary receptacle is in a closed position.

Referring now to the drawings, an embodiment of portable soap caddy assembly 10 can be seen in FIGS. 1–4. Assembly 10 has a toiletry receptacle 11 which has opening 12 and sidewall 14. Receptacle 11 is useful for holding various toiletry items such as shampoo, conditioner, etc. As can be seen in FIG. 2 the interior can be compartmentalized with partitioning means or walls 16 to keep various toiletry items separated. Toiletry receptacle 10 has a mounting means 18 for securing receptacle 10 to a vertical wall 20 positioning opening 12 of toiletry receptacle 11 upwardly.

The improvement to this assembly 10 includes auxiliary receptacle 22 having opening 24 and auxiliary receptacle sidewalls 26. The improvement further includes a mounting assembly for movably mounting auxiliary receptacle 22 to toiletry receptacle 12 between a first position in which auxiliary receptacle opening 24 is closed against toiletry receptacle sidewall 14, as seen in FIG. 1 in phantom, and a second position as shown in FIG. 1 where auxiliary receptacle 22 is positioned with opening 24 facing upwardly. Typically auxiliary receptacle 22 is utilized to carry bar soap or the like. In the closed position the soap is secured within auxiliary receptacle 22 and in the open position access is easily obtained to auxiliary receptacle 22 and its contents.

Typically this assembly 10 and its improvements are placed in a shower or bathroom environment and are therefore made of plastic or other water resistant material or the like. This is true for at least toiletry receptacle 11 and auxiliary receptacle 22.

Figure 3:
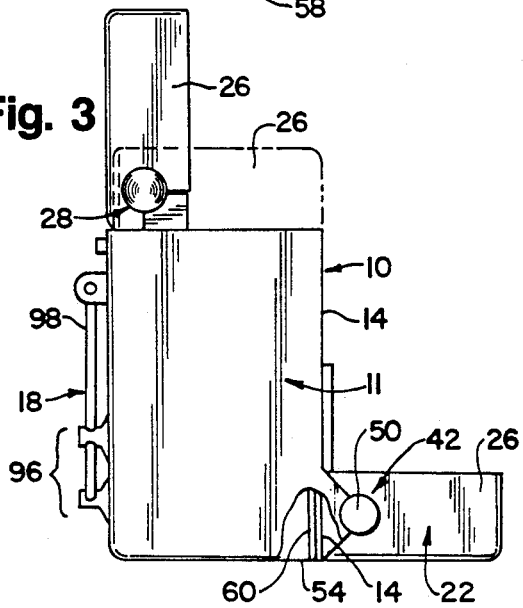
FIG. 3 is a partially broken away side elevation view of the portable soap caddy assembly in which the lid of the toiletry receptacle is open and is closed in phantom and the auxiliary receptacle is open.

Toiletry receptacle 11 has a lid 26 which is typically pivotally mounted to toiletry receptacle 11 by conventional pivot assembly 28, as seen in FIG. 3. Lid 26 is shown in an open position in FIG. 3 and a closed position in phantom.

Both toiletry receptacle 11 and auxiliary receptacle 22 have a bottom 30 and 32 and each have openings 34 and 36 respectively in their bottoms for draining water from the receptacles, as seen in FIG. 1.

Toiletry receptacle 11 provides a base wall 38, as seen in FIG. 1, which is substantially transverse to toiletry receptacle sidewall 14 and projects into a lower portion of auxiliary receptacle 22. Base wall 38 provides support to contents of auxiliary receptacle 22 particularly when receptacle 22 is moved from opened and closed positions. Base wall 38 also has openings 40 to permit drainage of water through base wall 38.

Now referring to the mounting assembly which was previously mentioned. The mounting assembly includes the following: pivotal mounting means 42 for pivotally mounting auxiliary receptacle 22 to sidewall 14 of toiletry receptacle 11; releasable securing means 44 to releasably secure auxiliary receptacle 22 into a first closed position, as shown in phantom in FIG. 1; and securing means 46 for securing auxiliary receptacle 22 in a second open position, as also shown in FIG. 1.

In looking at releasable securing means 44, in FIG. 1, auxiliary receptacle 22 is releasably secured in a first or closed position by both a wall portion 48 disposed on sidewall 14 which defines substantially the outside configuration and dimensions of a substantial portion of auxiliary receptable 22 to frictionally receive the same to sidewall 14 and by pivotal mounting means 42 which includes pivotal members 50 attached to toiletry receptacle 11 and which mechanically engage auxiliary receptacle in a conventional manner such as a pin insertion into an opening or the like. Securing means 44 maintains auxiliary receptacle 22 in a closed position.

In looking at securing means 46 for securing auxiliary receptacle 22 into a second open position, in FIG. 1, it includes pivotal mounting means 42, as discussed above, and a stop member. A stop member can be numerous conventional devices which will keep auxiliary receptacle 22 from moving downwardly any further than its open position. In the example of stop member in the drawings, it includes slots 52 on either side of toiletry receptacle sidewall 14 as seen in FIG. 1, and slot 54 at the bottom of said sidewall 14, as seen in FIG. 3, for receiving auxiliary receptacle sidewalls 56 and 58. Positioning sidewalls 56 and 58 into slots 52 thereby positions auxiliary receptacle sidewall 60, as seen in phantom in FIG. 1 and seen in FIG. 3, behind and abutting toiletry receptacle sidewall 14. This structure configuration prevents auxiliary receptacle 22 from downwardly moving from the open or second position. Once again many other conventional stop members can be used.

Figure 5:
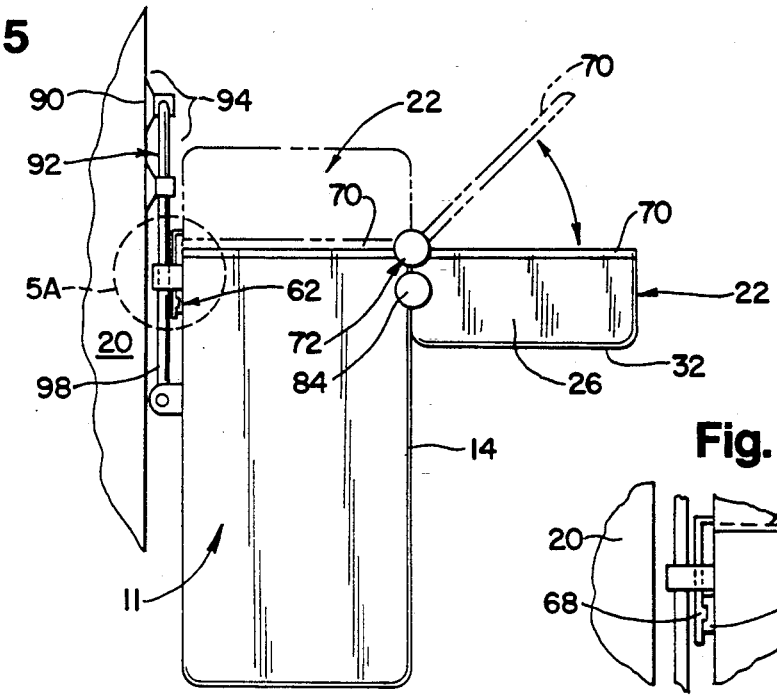
FIG. 5 is a side elevation view of another embodiment of the portable soap caddy assembly.
Figure 5A:
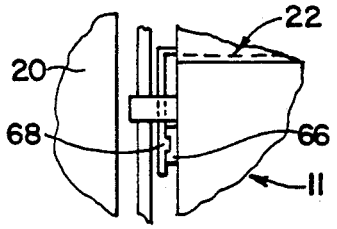
FIG. 5A is an enlarged view of the circled portion found in FIG. 5.
Figure 6:
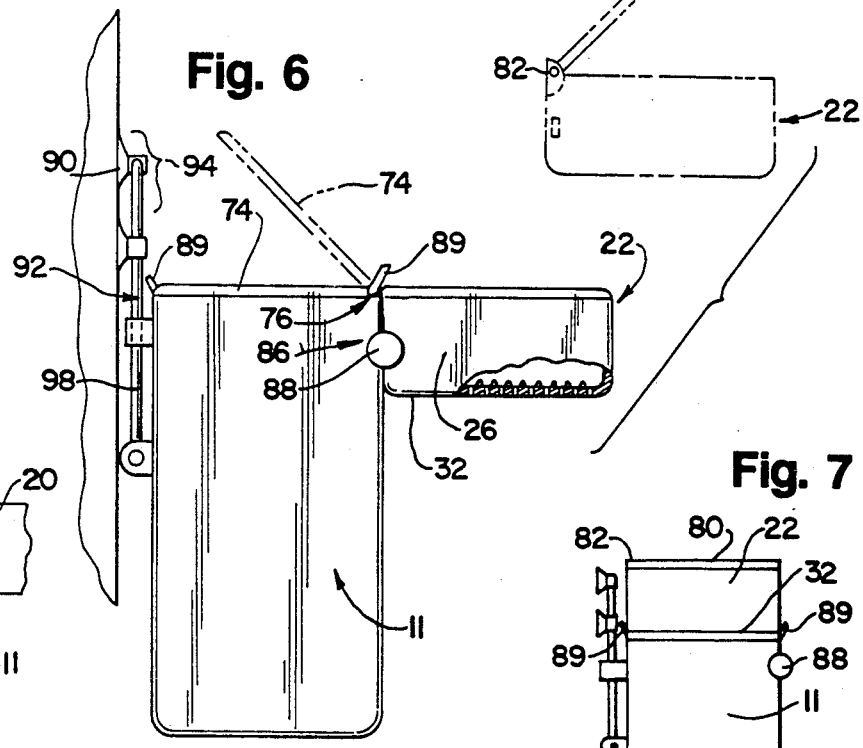
FIG. 6 is a side elevation view of another embodiment of the portable soap caddy assembly with another embodiment of the auxiliary receptacle in phantom.
Figure 7:
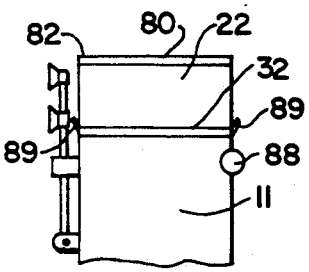
FIG. 7 is a partial side elevation view of another embodiment of the soap caddy assembly shown in FIG. 6.

Other embodiments of portable soap caddy assemblies can be seen in FIGS. 5, 6 and 7. Auxiliary receptacle 22, as seen in FIG. 5, has sidewall 26, bottom 32 and opening 24, seen in FIG. 1 more clearly. Means for mounting 62 auxiliary receptacle 22 to toiletry receptacle 11 is seen enlarged in FIG. 5A. Mounting means 62 can maintain auxiliary receptacle 22 in closed relationship with toiletry receptacle 11, as seen if FIG. 5. Such mounting means 62 is shown as a conventional latch assembly 64, as seen in FIG. 5A, having resilient female member 66 receiving resilient male member 68. Many other conventional mounting means 62 are contemplated such as providing a snap fit between auxiliary receptacle 22 and toiletry receptacle 11, and many other conventional constructions.

In the embodiment in FIG. 5, holding means is provided which is pivot mounting means 72 which pivotally mounts auxiliary receptacle 22 to toiletry receptacle 11. This can be a number of various pivot constructions such as a pin received by a hole. Thus, this construction permits auxiliary receptacle 22 to be positioned in a closed position to toiletry receptacle 11, as seen in phantom in FIG. 5 and permits auxiliary receptacle 22 to be moved to an opened position to rest against sidewall 14. Further securement can be provided if desired by adding resilient securing tabs 84 to further secure auxiliary receptacle 22 to sidewall 14.

Another embodiment of holding means can be seen in FIG. 6, in which snap fit engagement assembly 86, a conventional resilient ear 88 mounted to either side of toiletry receptacle 11 having complimentary male/-female members engage a corresponding complementary member on auxiliary receptacle 22, thereby holding the same in place against sidewall 14. In this embodiment auxiliary receptacle is completely removable from toiletry receptacle 11 and can be closed together by conventional snap fit members 89 which frictionally engage auxiliary receptacle 22. Many conventional holding means are contemplated by this invention which would releasably secure auxiliary receptacle 22 to toiletry receptacle 11 sidewall 14.

Means for partitioning auxiliary receptacle opening 24 from toiletry receptacle opening 12 are provided in a number of conventional ways, a few of which will be described here forward. One construction is having partitioning means be a lid 70 which can be pivotally mounted to both auxiliary receptacle 22 and toiletry receptacle 11 by pivot mounting means 72, as seen in FIG. 5. Another construction is to have partitioning means be lid 74 pivotally mounted by mounting 76 to toiletry receptacle 11, as seen in FIG. 6. Another construction is to have partitioning means be lid 80 pivotally mounted by mounting 82 to auxiliary receptacle 11, as seen in phantom figure in FIG. 6. Another construction of partitioning means is seen in FIG. 7 in which bottom 32 of auxiliary receptacle 11 is the partitioning means. Numerous conventional combinations and constructions of the partitioning means are contemplated by this invention.

Once again it can be mentioned all embodiments are preferred to be constructed of a water resistant material such as plastic or the like.

Figure 4:
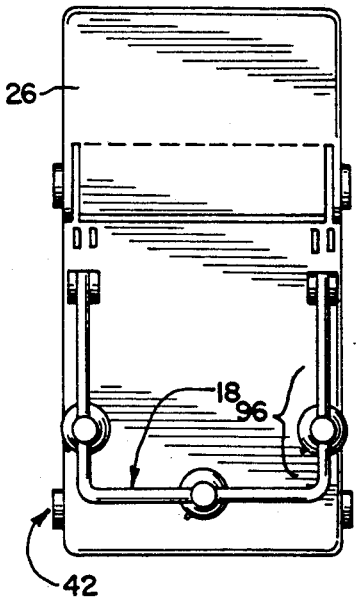
FIG. 4 is a back elevation view of the portable soap caddy assembly of FIG. 3.

Finally, another embodiment of this invention includes an improvement having releasable attachment mechanism 90 as seen in FIG. 1 and means for mounting 92 releasable attachment mechanism 90 between a wall mounting position as indicated as 94 in FIGS. 5 and 6 at which releasable attachment mechanism 90 is in a position for releasable attachment of toiletry receptacle 11 to wall 20. This releasable attachment mechanism 90 is a suction cup or other conventional like mechanism as seen in FIG. 1. The other position of means for mounting 92 is storage position, which is shown in FIGS. 3 and 4 indicated by 96. Storage position 96 is a position in which releasable attachment mechanism 90 or at least one suction cup is releasably secured to a sidewall of toiletry receptacle 11 and not useable for a wall mounting position 94. Mounting means 92 or bracket 98 or the like is pivotally mounted, as seen in FIGS. 3 and 4, to a sidewall of toiletry receptacle 11. Storage position 96 has at least one suction cup, which is mounted to bracket 98, releasably secured to the sidewall of toiletry receptacle 11.

Bracket 98 in the wall mounting position 94 extends above the sidewall of toiletry receptacle 11, as seen in FIGS. 5 and 6, to provide ease in grasping bracket 98 and could be used to carry the portable soap caddy assembly, as well.

Figure 8:
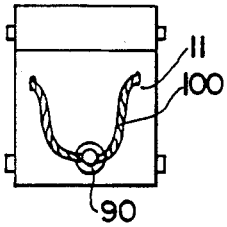
FIG. 8 is a backview of portable soap caddy assembly showing another embodiment of the releasable attachment mechanism and mounting means.
Figure 8A:
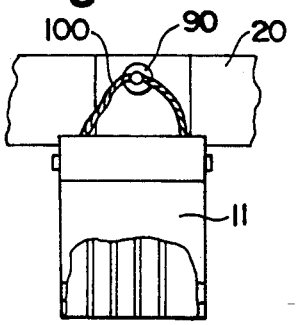
FIG. 8A is a front view of portable soap caddy assembly shown in FIG. 8 mounted to a wall.

Another embodiment of the mounting means is seen in FIGS. 8 and 8A. Here, a flexible cord 100 is shown mounted to the back side of toiletry receptacle 11 in FIG. 8. Secured to flexible cord 100 is releasable attachment mechanism 90 or suction cup. As can be seen in FIG. 8A, said wall mounting position, flexible cord 100 extends above toiletry receptacle 22 to provide ease in grasping flexible cord 100 and could be used to carry portable soap caddy assembly 10. In said storage position the suction cup is secured to a side wall of toiletry receptacle 11. In said wall mounting position the suction cup is secured to wall 20.

While a detailed description of the preferred embodiment and other embodiments of the invention has been given it should be appreciated that many variations can be made there to without departing from the scope of the invention as set forth in the appended claims.

I claim:

1. In a portable soap caddy assembly with a toiletry receptacle for holding various toiletries having an opening and a sidewall, means for mounting the receptacle to a vertical wall with the opening facing upwardly, the improvement comprising:

an auxiliary receptacle with an opening, a sidewall, and a bottom; and means for mounting said auxiliary receptacle to the toiletry receptacle to close said toiletry receptacle opening;

means for partitioning said auxiliary receptacle opening from said toiletry receptacle opening, which includes a lid disposed between the toiletry receptacle and auxiliary receptacle that separates the auxiliary receptacle opening from the toiletry receptacle opening when the auxiliary receptacle closes the toiletry receptacle opening; and means for holding said auxiliary receptacle against said sidewall of said toiletry receptacle opening facing upwardly.

2. The portable soap caddy assembly of claim 1 in which said toiletry receptacle is plastic.

3. The portable soap caddy assembly of claim 1 in which said auxiliary receptacle is plastic.

4. The portable soap caddy assembly of claim 1 in which said means for mounting includes a latch assembly.

5. The portable soap caddy assembly of claim 1 in which said holding means includes a means for pivotally mounting said auxiliary receptacle to said toiletry receptacle.

6. The portable soap caddy assembly of claim 5 in which said lid is mounted to said toiletry receptacle to close said opening of said toiletry receptacle.

7. The portable soap caddy assembly of claim 6 in which said lid is pivotally mounted to said toiletry receptacle.

8. The portable soap caddy assembly of claim 5 in which said lid is mounted to said auxiliary receptacle to close said opening of said toiletry receptacle.

9. The portable soap caddy assembly of claim 8 in which said lid is pivotally mounted to said auxiliary receptacle.

10. The portable soap caddy assembly of claim 1 in which said holding means includes a snap fit engagement assembly mounted between said sidewall of said auxiliary receptacle and said sidewall of said toiletry receptacle.

11. The portable soap caddy assembly of claim 10 in which said partitioning means includes said bottom of said auxiliary receptacle.

12. The portable soap caddy assembly of claim 10 in which said partitioning means includes a lid on said auxiliary receptacle.

13. The portable soap caddy assembly of claim 12 in which said lid is pivotally mounted to said auxiliary receptacle.

14. The portable soap caddy assembly of claim 10 in which said partitioning means includes a lid on said toiletry receptacle.

15. The portable soap caddy assembly of claim 14 in which said lid is pivotally mounted to said toiletry assembly.

16. A portable soap caddy assembly with a toiletry receptacle having an opening and a sidewall for holding various toiletries, the improvement comprising:

a releasable attachment mechanism; and means for mounting the releasable attachment mechanism between a wall mounting position in which the releasable attachment mechanism is in a position for releasable attachment of the toiletry receptacle to the wall and a storage position in which the releasable attachment mechanism is in secured contact and is directly releasably secured to the sidewall of the toiletry receptacle.

17. The portable soap caddy assembly of claim 16 in which said releasable attachment mechanism includes at least one suction cup.

18. The portable soap caddy assembly of claim 17 in which said mounting means includes a bracket pivotally mounted to said sidewall of said toiletry receptacle in which said storage position includes said at least one suction cup releasably securing to said sidewall of said toiletry receptacle.

19. The portable soap caddy assembly of claim 18 in which said bracket in said wall mounting position extends above said sidewall of said toiletry receptacle.

20. The portable soap caddy assembly of claim 16 in which said releasable attachment mechanism includes at least one suction cup secured to said mounting means which includes a flexible cord member mounted to said sidewall of said toiletry receptacle.

21. The portable soap caddy assembly of claim 20 in which said flexible cord member in said wall mounting position extends above said sidewall of said toiletry receptacle.

* * * * *